United States Patent [19]

Kales

[11] Patent Number: 4,483,356

[45] Date of Patent: Nov. 20, 1984

[54] HAND-HELD LOTION APPLICATOR

[76] Inventor: Donna R. Kales, 14204 E. First Dr., Aurora, Colo. 80011

[21] Appl. No.: 407,266

[22] Filed: Aug. 11, 1982

[51] Int. Cl.[3] ..... A45D 40/26

[52] U.S. Cl. ..... 132/88.7; 15/209 D; 401/126; 128/67

[58] Field of Search ..... 132/88.5, 88.7, 1; 15/106, 172, 173, 201, 209 E, 209 D, 210 R, 230, 144 R; 222/556; 128/34, 62 R, 67

[56] References Cited

U.S. PATENT DOCUMENTS

| | | | |
|---|---|---|---|
| 1,127,195 | 2/1915 | Cummings | 15/106 |
| 1,431,881 | 10/1922 | Ericson-Smith | 15/208 |
| 1,478,388 | 12/1923 | Gray | 128/54 |
| 1,501,656 | 7/1924 | Gilda | 132/84 D |
| 2,104,744 | 1/1938 | Hothersall | 222/556 |
| 2,218,862 | 10/1940 | Vredenburgh | 132/1 |
| 2,249,727 | 7/1941 | Butler | 15/209 D |
| 2,426,288 | 8/1947 | Wagner | 15/144 R |
| 2,469,050 | 5/1949 | Mygas | 15/144 R |
| 2,867,832 | 1/1959 | Hanninen | 15/144 R |
| 2,993,222 | 7/1961 | Laymon | 15/144 R X |
| 3,061,861 | 11/1962 | Hartmann | 15/209 D |
| 3,631,562 | 1/1972 | Kieves | 15/172 |
| 3,856,002 | 12/1974 | Matsumoto | 128/67 |
| 4,257,616 | 3/1981 | Pless | 401/126 |

*Primary Examiner*—Gregory E. McNeill
*Attorney, Agent, or Firm*—John E. Reilly

[57] ABSTRACT

A lotion applicator employs a length-adjustable handle into which is inserted a flexible bale with a pad attached thereto which adjustably swivels on the handle so that the flattened pad remains in uniform contact with the user's skin. The flexible bale may also be adaptable for attachment to the applicator. The applicator is constructed of a soft plastic with a flip-top cap and may serve as an extension of the handle. When the flip-top cap is open and the applicator tilts downwardly, the lotion drips onto the pad.

8 Claims, 7 Drawing Figures

HAND-HELD LOTION APPLICATOR

This invention relates to applicators, and more particularly relates to a novel and improved device for use in applying fluids and other cosmetic preparations to the human body and which is specifically adaptable for use in applying liquid cosmetic preparations, such as, sun tan lotion to the skin.

BACKGROUND AND FIELD OF THE INVENTION

Applicators have been devised in the past which customarily employ disc-shaped pads in combination with handles for applying lotions and other cosmetic preparations to various hard-to-reach parts of the body. Representative of this approach are disclosed in U.S. Pat. Nos. 1,478,388 to Gray and 3,856,002 to Matsumato, as well as 1,431,881 to Ericson-Smith and 2,218,862 to Vredenburgh. Of these patents, Gray and Matsumato are of interest for disclosing massage-type implements comprising disc-shaped pads mounted on resilient or otherwise adjustable handles. The Ericson-Smith and Vredenburgh patents are of general interest for showing the general configuration of a long curved handle and circular flat pad for application of talcum powder and inclined outliner for lip rouge, respectively.

Although it has been proposed previously to employ circular pads in combination with a handle portion to self-apply various substances to the body, it has been impractical to accomplish same easily and comfortably, as well as smoothly and evenly, as proposed in the present invention through the novel approach and design of a telescoping handle in combination with a swivel-type applicator head or pad suspended by a wire bale so as to be adjustable to the angle of the handle portion.

Accordingly, among the deterrents to applicators in the prior art has been the inability to balance the forces applied to different points on the surface of the pad through manipulation of the handle portion. An associated deterrent has been the absence of design for a swivel-type pad which will adjust to the angle of the handle itself to control smooth, even application of the lotion or other fluid medium being applied.

SUMMARY OF INVENTION

It is therefore an object of the present invention to provide for a novel and improved self-applicator for applying lotions or other cosmetic preparations to hard-to-reach areas of the body wherein the applicator can be hand-held and controlled through its handle portion for smooth and even distribution of the medium to the skin.

It is another object of the present invention to provide for a novel and improved applicator for lotions and the like that is simple in construction, inexpensive to manufacture and efficient in use and service.

It is an additional object of the present invention to provide an applicator which is both length-adjustable and bendable to different angles or attitudes whereby to facilitate uniform application of a lotion to hard-to-reach areas of the skin of the user.

It is another object of the present invention to provide in an applicator a novel and improved construction for the balanced application of the lotion or other fluid medium through the double-faced pad easily and comfortably to different areas of the body.

It is still a further object of the present invention to provide for a new and improved applicator wherein a flexible bale and swivel pad assembly is attachable to a lotion container in such a way that the container may form the handle portion of the applicator; and to permit lotion to be deposited onto the pad from the container without removal of the assembly from the container.

In accordance with the present invention, the preferred form of lotion applicator employs a length-adjustable handle into which is inserted a bendable or flexible bale or support assembly having an applicator pad or disc attached thereto which adjustably swivels on the handle in a manner such that the flattened surface of the pad remains in uniform contact with the skin of the user.

In an alternate form of the present invention, the flexible bale or support assembly is adaptable for attachment to the applicator container. The applicator bottle may be constructed of a soft plastic or pliable material with the cap portion of the bottle having a flip-top opening therein. In this embodiment, the applicator bottle serves as an extension of the handle portion. When the applicator bottle or container is tilted in a downward plane and the flip-top tab is in the open position, the lotion or fluid is allowed to drip onto the pad for saturation. Further, slight pressure can be applied to the pliable applicator bottle to permit the fluid to flow more rapidly onto the pad if desired.

The foregoing and other characteristics of the present invention make it ideally suited for use in applying lotion and other cosmetic preparations, and in particular fluid media, to areas of the body not visually accessible to the user.

The above and other objects, advantages and features of the present invention will become more readily appreciated and understood from a consideration of the following detailed description of a preferred and alternate embodiment of the present invention when taken together with the accompanying drawings of a preferred embodiment of the present invention, in which:

DETAILED DESCRIPTION OF THE PREFERRED EMBODIMENT

Figure 1:
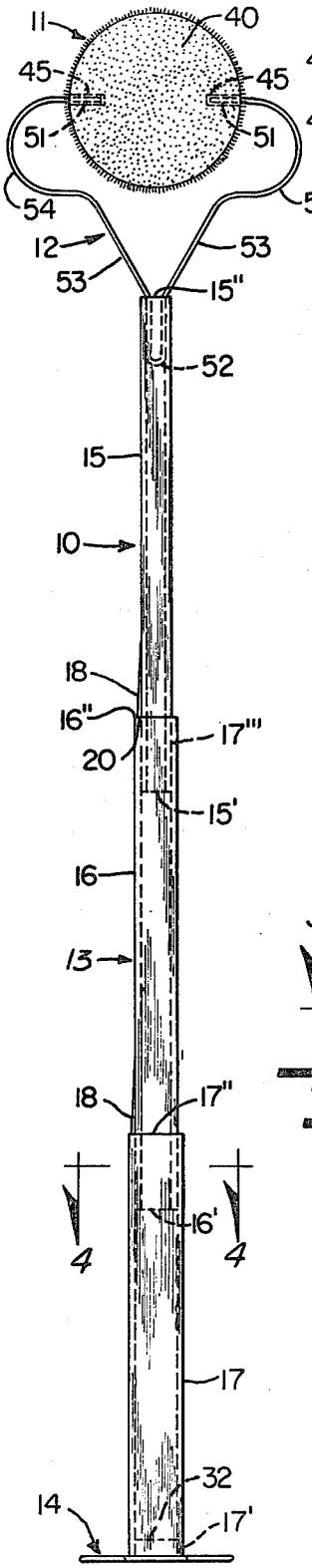
FIG. 1 is a front view in elevation of a preferred form of applicator and telescoping handle in accordance with the present invention.

Referring in more detail to the drawings, and in particular to FIGS. 1 to 5, there is shown a preferred form of hand-held lotion applicator 10 which is designed to facilitate the application of fluids, such as, lotions to the body, particularly to the back and shoulders. To this end, the applicator 10 comprises a saturable pad portion 11, a bale or support assembly generally indicated at 12, an extensible handle portion 13, and container-receiving means 14.

Length-adjustable handle 13 may be of the telescoping variety having an upper tubular member 15, intermediate tubular member 16, and lower tublar member 17. Each of the tubular members 15, 16, 17 is hollow and adapted to slide into its adjacent larger tubular member so as to permit the handle 13 to be retracted to a length substantially corresponding to the length of the longest tubular member, or extended to a length several times its length in the retracted mode. Each tubular member is provided with suitable means for releasably securing said tubular members in extended relationship to each other. For example, with specific reference to FIGS. 1 to 5, upper tubular member 15 and intermediate tubular member 16 each are provided with an integral projection 18 formed near the respective trailing ends 15', 16' of tubular members 15, 16. Projections 18 are spaced from the end 15', 16' a distance sufficient to maintain stability of the handle 13 as a whole, as represented by the segment 17'''. Projections 18 are angled outwardly from the vertical axis of the handle 13.

Figure 4:
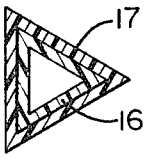
FIG. 4 is a cross-sectional view taken along lines 4—4 of FIG. 1 of the handle showing the telescoping portion in nested relation.

With reference to the upper tubular member 15, projection 18 terminates in a shoulder 20 which abuts upper end 16'' of intermediate tubular member 16 and retains the handle 13 in the extended position. Projection 18 on intermediate tubular member 16 is provided with a similar shoulder 20 abutting upper end 17'' of lower tubular member 17 and serving the same purpose as described above. Retraction of handle 13 is effected by compressing projections 18 into axial alignment with tubular members 15, 16, as shown in phantom in FIG. 5, allowing shoulders 20 to pass into the upper ends 16'', 17'' of respective tubular members 16, 17 so that tubular members 15, 16, 17 may be drawn into nesting relationship to each other. In the preferred embodiment, tubular members 15, 16, 17 are triangular in cross-section, as illustrated in FIG. 4; however, they may be of any cross-sectional configuration which allows them to be retracted as described above.

Lower tubular member 17 is releasably seated on container-receiving means 14 which comprises a clip 30 having a widened portion 31 formed thereon. A triangular projection 32 on widened portion 31 is sized for close-fitting insertion into trailing end 17' of lower tubular member 17, as best shown in cross-section in FIG. 3. Arms 33 of the clip 30 are formed in a general C-shape of a somewhat bendable material so as to be deformable to surround a fluid container or bottle, not shown, so that the container may be employed as an extension of the applicator device 10.

Pad portion 11 comprises a saturable, relatively flat disk-shaped pad 40 having opposite, outwardly facing surfaces 41, 42 joined by a narrow circumferential edge 43. The pad may be constructed of a suitable, durable material and is preferably covered with a textured material, such as, acrylic plush having fibers 44 suitable for receiving and retaining fluid applied thereto. The edge 43 of the pad 40 is provided with a pair of diametrically opposed recesses 45 for a purpose to be hereinafter described.

Figure 2:
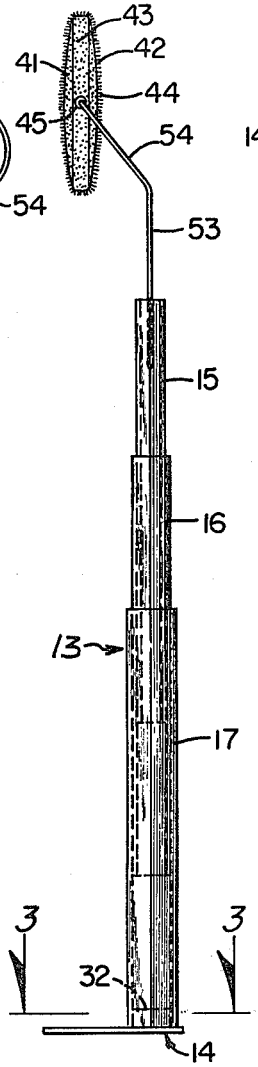
FIG. 2 is a side view illustrating the swivel arrangement of the double-faced pad and wire bale in relation to the telescoping handle in accordance with the present invention.
Figure 5:
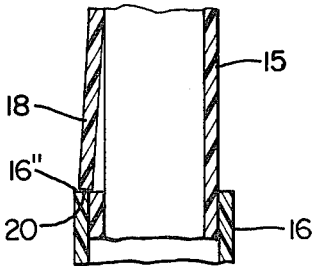
FIG. 5 is a front view in detail of the means for retaining the telescoping handle members in extended relation.

The pad support assembly 12 is formed in one piece from a metal wire or the like. The wire must be bendable to some degree so that the support assembly 12 will yield somewhat in response to pressure, but nonetheless must be capable of retaining its shape under normal use. The wire is bent sharply intermediate its free ends 51 to form a tip portion 52 which is inserted into the support assembly-receiving upper end 15'' of upper tubular member 15, and fits closely therewithin. Thus inserted, the wire forms a pair of arms 53 which diverge from the vertical axis of the handle 13. With reference to FIGS. 1 and 2, the arms then curve in a further outward direction, then toward one another, the curved portion 54 angling forward from the vertical axis of the handle 13 at an acute angle. Each of free ends 51 are received in one of the pair of recesses 45 formed in pad 40, recesses 45 and free ends 51 extending into the pad 40 a sufficient distance to assure that the pad is held securely yet movably on the free ends 51, while still allowing removal of the pad therefrom for cleaning or replacement. It is preferred that recesses 45 be sized to allow pad 40 a certain amount of swiveling or rotational movement about the free ends 51, for reasons which will become apparent in consideration of operation of the device.

The present invention may be advantageously employed in several applications; however, its operation will be described with specific reference to its utility as a device for applying lotions, such as, suntan preparations to a user's back and shoulders. First, the handle 13 is extended to a desired length; if additional length is required, the lower end 17' of lower tubular member 17 may be seated on the projection 32 of the C-clip 30. The arms 33 of the clip 30 are deformed outwardly and a lotion bottle positioned therebetween. Clip arms 33 are then released to assume their normal converging attitude thereby retaining the bottle within the clip 30. A small amount of lotion is applied to one or both of the saturable surfaces 41, 42 of the pad 40. Holding either the lower tubular member 17 or the bottle within clip 30, the user manipulates the applicator 10 to bring pad 40 into contact with the desired area of the back or shoulders. By virtue of the bendable resiliency of the pad support assembly 12 in combination with the ability of the pad 40 to swivel thereon, one of the pad surfaces 41, 42 may be kept in full and continuous contact with the user's back as the applicator 10 is moved to different areas. This arrangement facilitates greater speed and efficiency in applying fluids, as well as more uniform coverage: The angle of the applicator 10 changes with respect to the body as the device is moved to different areas; to compensate, the support assembly 12 may be flexed slightly and the pad 40 allowed to swivel so that it maintains contact with the skin along the entire area of pad surface 41 or 42.

When one surface of the pad 40 becomes depleted of lotion, the user simply may raise the pad 40 from contact with the skin and flip or reverse the applicator 10 so that the opposite, unused pad surface is in contact with the skin. In the alternative, one pad surface may be left "dry", so that if too much lotion remains on the skin after application, the device may be turned in the same manner, and the dry surface may be used to wipe up the excess.

It will be noted, however, that this description is merely by way of example and is not intended to limit uses for and operation of the device. For example, it is not required that lotion be spread directly on the pad; lotion may be applied to the body and then spread evenly by the applicator 10 in the manner described above. The pad 40 may be removed for cleaning or replacement by pulling the support assembly arms 53 outwardly so that the free ends 51 are clear of the recesses 45.

After use, the extended applicator handle 13 may be retracted for convenient storage by compressing the projections 18 toward the vertical axis of the handle 13, so as to allow the tubular members 15, 16, 17 to slide together into nesting relationship to one another.

DETAILED DESCRIPTION OF ALTERNATE EMBODIMENTS OF THE PRESENT INVENTION

Figure 6:
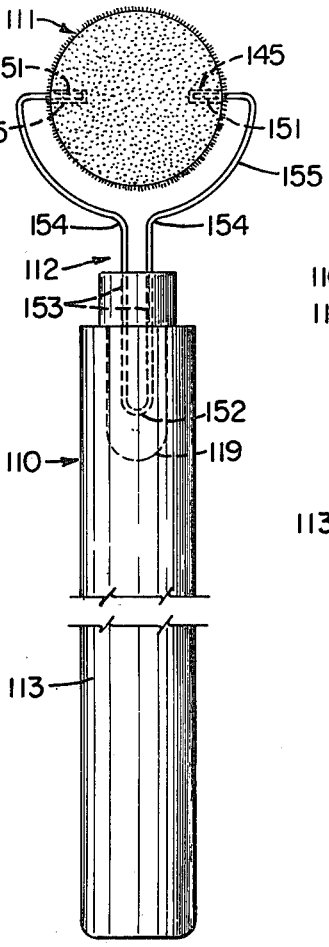
FIG. 6 is a front view of an alternate form of invention illustrating the flexible wire bale attached to an applicator bottle wherein the applicator bottle is the handle portion.
Figure 7:
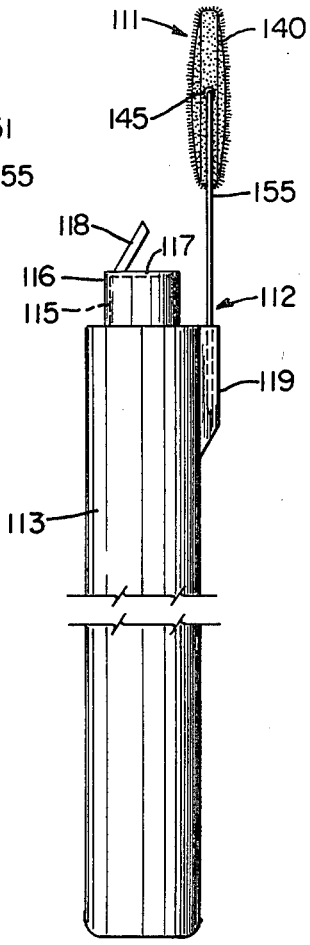
FIG. 7 is a side view of the alternate form of invention illustrating the flip top in relation to the applicator pad.
Figure 3:
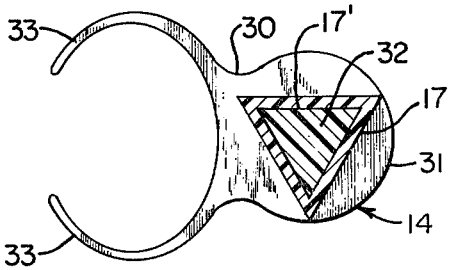
FIG. 3 is a cross-sectional view taken along lines 3—3 of FIG. 2 showing a ring-like clip member for attaching the telescoping handle to the container.

FIGS. 6 and 7 show an alternate embodiment of the present invention in which like parts are correspondingly enumerated to those of FIGS. 1 and 2 wherein a lotion applicator 110 comprises in combination a fluid container/handle 113 having means formed thereon for receiving a pad support assembly 112 and further means for depositing fluid or lotion onto a pad portion 111 for subsequent application to the body. Fluid container/-handle 113 may be of any appropriate shape, but is preferably cylindrical and of a length sufficient to permit its use as a handle or extension for pad support assembly 112. Container 113 is formed of a somewhat pliable or yielding material, such as, a flexible plastic so that fluid may be dispensed by applying pressure to the exterior cylinder wall. The container is provided with a mouth 115 which is adapted to receive a cap 116 having a conventional flip-top nozzle 118 which may be raised to permit the fluid to flow therethrough, and closed by lowering it to a position flush with the upper surface 117 of the cap 116. Cap 116 may be secured on mouth 115 by any appropriate means, such as, by complementary threading.

Container 113 is provided with a container-engaging member 119 which projects slightly from and is formed integrally on container 113 and provided with a socket to permit insertion of the common end of the bale arms hereinafter described.

As illustrated in FIG. 6, pad support assembly 112 is formed from a single wire or strand of bendable, somewhat resilient material, as in the corresponding structure of the preferred embodiment. The wire is bent sharply intermediate its free ends 151, to form two arms extending from a rounded or U-shaped tip 152 which is insertable into the socket member 119 and may be cemented therein with a suitable adhesive. Arms 153 are then bent in opposite directions, as at 154, then curved generally toward one another as at 155. Finally, free ends 151 of arms 153 are bent inwardly and into horizontal alignment, for insertion into recesses 145 in pad 140. Pad 140 is substantially identical to the pad 40 of the preferred embodiment, and therefore will not be described further with respect to the alternate embodiment.

Operation of the device is in essentially the same manner as for the preferred embodiment, the primary difference being in the application of lotion to the pad 40. Specifically, the integrated combination of fluid container 113 and applicator pad arrangement 111 allows lotion to be rapidly and conveniently dispensed directly on the pad 140 by merely opening the flip-top nozzle 118, tilting container 113 in a downward plane, and squeezing container 113 until a desired amount of fluid has been deposited on the pad. The nozzle 118 is then moved to a closed position; thereafter, the applicator 110 may be employed in the manner heretofore disclosed. It is understood that the pad support assembly 112 could also be adjustable, for example, by employing a telescoping type of wire bale or any other suitable means.

It is to be understood from the foregoing that while preferred and alternate forms of the present invention have been set forth, it should be appreciated by those skilled in the art that various modifications, changes and adaptations may be made without departing from the scope of the present invention as defined by the following claims.

I claim:

1. A hand-held applicator adaptable for self-applying a cosmetic fluid medium to the human body, comprising in combination:

a handle portion movable between an extended and retracted position having a plurality of telescoping length-adjustable members including an uppermost member provided with a pad support-receiving upper recessed end, said length-adjustable members define by a plurality of telescoping tubular members of triangular cross-sectional configuration, said tubular members dimensioned to fit in nesting relationship to one another to permit retraction of said handle portion into said retracted position, and said tubular members further being extendible from said retracted position to said extended position having a length greater than the length of said handle portion in said retracted position;

a substantially flat, disk-shaped pad having at least one outwardly facing fluid-receiving surface with an outer peripheral edge; and a pad support bale seated in said upper receiving end of said uppermost length-adjustable member having a pair of bendable arms and swivel connecting means for swiveled connection of said arms to said outer peripheral edge of said pad, said bendable arms having a common end axially inserted a measured distance into said receiving end of said uppermost length-adjustable member of said handle portion and having two free ends bent away from the vertical axis of said handle portion, then angled forwardly and curved toward one another, said arms terminating a spaced distance from each other, said distance being slightly less than the diameter of said disk-shaped pad.

2. An applicator according to claim 1, said peripheral edge of said disk-shaped pad having a pair of diametrically opposed recesses formed thereon, each said recess defining said connecting means for releasable insertion of one of said free ends of said bendable arms of said pad support bale, said pad being freely rotatable one said free ends and releasable therefrom by outward bending of said arms whereby to withdraw said free ends from said recesses.

3. An applicator according to claim 1, said disk-shaped pad having a pair of opposed outwardly facing surfaces thereon, each provided with a porous, saturable, fluid-receiving cover fabric.

4. An applicator according to claim 2, including locking means comprising an integral projection formed near one end of each of said tubular members, said projection on a first said tubular member having a shoulder adapted to abut an opposite end of an adjacent tubular member when said handle portion is extended, and each successive tubular member having said locking means for engaging an opposite end of the next adjacent tubular member, said projections being retractible under pressure to permit said tubular members to telescope freely into the retracted position.

5. In an applicator for applying fluid medium to the body wherein a fluid container of a pliant material has a mouth formed integrally thereon, the combination therewith comprising:

a substantially flat, disk-shaped pad having at least one outwardly facing fluid-receiving surface with an outer circumferential edge;

a pad support bale having a pair of bendable arms and swivel connecting means on said circumferential edge of said pad releasably interconnecting said bendable arms to said pad for free swiveling movement of said pad with respect to said bendable arms, said bendable arms having a common end axially inserted into said container-engaging means and having two free ends bent away from the vertical axis of said fluid container, then curved toward one another, said arms terminating a spaced distance from each other, said distance being slightly less than the diameter of said disk-shaped pad; and container-engaging means formed integrally on said fluid container to support said bale as an extension of said container.

6. In an applicator according to claim 5, said swivel connecting means comprising diametrically opposed recesses formed on said circumferential edge of said disk-shaped pad, each receiving one of said free ends of said pair of arms of said pad support bale for swiveled movement of said pad about an axis transverse to said bale.

7. In an applicator according to claim 5, said disk-shaped pad having a pair of opposed, outwardly facing surfaces thereon, each being provided with a porous, saturable, fluid-receiving cover fabric.

8. In an applicator according to claim 7, said container-engaging means having a socket portion for insertion of said common end of said bendable arms.

* * * * *

UNITED STATES PATENT AND TRADEMARK OFFICE

CERTIFICATE OF CORRECTION

PATENT NO. : 4,483,356

DATED : 20 November, 1984

INVENTOR(S) Kales, Donna R.

It is certified that error appears in the above-identified patent and that said Letters Patent is hereby corrected as shown below:

| Column | Line No. | Error |
|---|---|---|
| 6 | 20 | Cancel "define" and substitute -- defined -- |
| 6 | 52 | Cancel "one" and substitute -- on -- |
| 6 | 56 | Cancel "1" and substitute -- 2 -- |
| 8 | 17 | Cancel "7" and substitute -- 5 -- |

Signed and Sealed this

*Ninth* Day of *April 1985*

[SEAL]

*Attest:*

DONALD J. QUIGG

*Attesting Officer* *Acting Commissioner of Patents and Trademarks*